US008857564B2

(12) United States Patent
Ma et al.

(10) Patent No.: US 8,857,564 B2
(45) Date of Patent: Oct. 14, 2014

(54) ACOUSTIC METAMATERIAL WITH SIMULTANEOUSLY NEGATIVE EFFECTIVE MASS DENSITY AND BULK MODULUS

(71) Applicant: The Hong Kong University of Science and Technology, Hong Kong (CN)

(72) Inventors: Guancong Ma, Hong Kong (CN); Min Yang, Hong Kong (CN); Ping Sheng, Hong Kong (CN); Zhiyu Yang, Hong Kong (CN)

(73) Assignee: The Hong Kong University of Science and Technology, Hong Kong (CN)

( * ) Notice: Subject to any disclaimer, the term of this patent is extended or adjusted under 35 U.S.C. 154(b) by 0 days.

(21) Appl. No.: 14/065,563

(22) Filed: Oct. 29, 2013

(65) Prior Publication Data

US 2014/0116802 A1 May 1, 2014

Related U.S. Application Data

(60) Provisional application No. 61/796,024, filed on Nov. 1, 2012.

(51) Int. Cl.
*E04B 1/82* (2006.01)

(52) U.S. Cl.
USPC ..... 181/286; 181/284

(58) Field of Classification Search
USPC ..... 181/286, 284
See application file for complete search history.

(56) References Cited

U.S. PATENT DOCUMENTS

| | | | | |
|---|---|---|---|---|
| 2,541,159 | A * | 2/1951 | Geiger | 181/208 |
| 4,373,608 | A * | 2/1983 | Holmes | 181/202 |
| 4,421,811 | A | 12/1983 | Rose et al. | |
| 5,241,512 | A * | 8/1993 | Argy et al. | 367/1 |
| 5,942,736 | A * | 8/1999 | Cortonesi | 181/289 |
| 6,576,333 | B2 | 6/2003 | Sheng et al. | |
| 7,395,898 | B2 * | 7/2008 | Yang et al. | 181/286 |
| 7,410,126 | B2 | 8/2008 | Drost | |
| 7,703,575 | B2 * | 4/2010 | Berger et al. | 181/293 |
| 8,172,036 | B2 * | 5/2012 | Tanielian | 181/207 |
| 8,360,201 | B2 * | 1/2013 | Tanase | 181/291 |
| 8,616,330 | B1 * | 12/2013 | McKnight et al. | 181/207 |
| 8,739,926 | B1 * | 6/2014 | Mori | 181/291 |
| 2003/0062217 | A1 | 4/2003 | Sheng et al. | |
| 2005/0103568 | A1 * | 5/2005 | Sapoval et al. | 181/293 |

OTHER PUBLICATIONS

Yang, Z., Dai, H., Chan, N., Ma, G. & Sheng, P. Acoustic metamaterial panels for sound attenuation in the 50-1000 Hz regime. Appl. Lett. Phys. 96, 041906 (2010).

(Continued)

*Primary Examiner* — Forrest M Phillips
(74) *Attorney, Agent, or Firm* — Nath, Goldberg & Meyer; Jerald L. Meyer; Stanley N. Protigal

(57) ABSTRACT

A device with simultaneous negative effective mass density and bulk modulus has at least one tubular section and front and back membranes sealing the tubular section. The front and back membranes sealing the tubular sections seal the tubular section sufficiently to establish a sealed or restricted enclosed fluid space defined by the tubular section and the membranes, and restrict escape or intake of fluid resulting from acoustic vibrations. A pair of platelets are mounted to the membranes, with the individual platelets substantially centered on respective ones of the front and back membranes.

12 Claims, 12 Drawing Sheets

(56) References Cited

OTHER PUBLICATIONS

Estrada, H., Candelas, P., Uris, A., Belmar, F., Garcia de Abajo, F. J. & Meseguer, F. Extraordinary sound screening in perforated plates. Phys. Rev. Lett. 101, 84302 (2008).
Zhang, S., Xia, C. & Fang, N. Broadband Acoustic Cloak for Ultrasound Waves. Phys. Rev. Lett. 106, 024301 (2011).
Popa, B. I., Zigoneanu, L. & Cummer, S. A. Experimental Acoustic Ground Cloak in Air. Phys. Rev. Lett. 106, 253901 (2011).
Sanchis, L., Garcia-Chocano, V. M., Llopis-Pontiveros, R., Climente, A., Martinez-Pastor, J., Cervera, F. & Sánchez-Dehesa, J. Three-Dimensional Axisymmetric Cloak Based on the Cancellation of Acoustic Scattering from a Sphere. Phys. Rev. Lett. 110, 124301 (2013).
Li, J., Fok, L., Yin, X., Bartal, G. & Zhang, X. Experimental demonstration of an acoustic magnifying hyperlens. Nat. Mater. 8, 931-934 (2009).
Zhu, J., Christensen, J., Jung, J., Martin-Moreno, L, Yin, X., Fok, L., Zhang, X. & Garcia-Vidal, F. J. A holey-structured metamaterial for acoustic deep-subwavelength imaging. Nat. Phys. 7, 52-55 (2011).
Lemoult, F., Kaina, N., Fink, M. & Lerosey, G. Wave propagation control at the deep subwavelength scale in metamaterials. Nat. Phys. 9, 55 (2013).
Mei, J., Ma, G., Yang, M., Yang, Z., Wen, W. & Sheng, P. Dark acoustic metamaterials as super absorbers for low-frequency sound. Nat. Commun. 3, 756 (2012).
Mei, J., Ma, G., Yang, M., Yang, J. & Sheng, P. In Acoustic Metamaterials and Phononic Crystals (ed Pierre A. Deymier) 159-199 (Springer Berlin Heidelberg, 2013).
Yang, M., Ma, G., Yang, Z. & Sheng, P. Coupled Membranes with Doubly Negative Mass Density and Bulk Modulus. Phys. Rev. Lett. 110, 134301 (2013).
Lai, Y., Wu, Y., Sheng, P. & Zhang, Z. Q. Hybrid elastic solids. Nat. Mater. 10, 620 (2011).
Wu, Y., Lai, Y. & Zhang, Z. Q. Elastic metamaterials with simultaneously negative effective shear modulus and mass density. Phys. Rev. Lett. 107, 105506 (2011).
Milton, G. W. & Willis, J. R. On modifications of Newton's second law and linear continuum elastodynamics. Proc. R. Soc. A 463, 855 (2007).
Milton, G. W. New metamaterials with macroscopic behavior outside that of continuum elastodynamics. New. J. Phys. 9, 359 (2007).
Cox, T. J. & D'antonio, P. Acoustic absorbers and diffusers: theory, design and application. (Taylor & Francis Group, 2009).
Maa, D.-Y. Potential of microperforated panel absorber. J. Acoust. Soc. Am. 104, 2861 (1998).
Lu, M.-H., Liu, X.-K, Feng, L., Li, J., Huang, C.-P., Chen, Y.-F., Zhu, Y.-Y., Zhu, S.-N. & Ming, N.-B. Extraordinary acoustic transmission through a 1D grating with very narrow apertures. Phys. Rev. Lett. 99, 174301 (2007).
Estrada, H., Garcia de Abajo, F. J., Candelas, P., Uris, A., Belmar, F. & Meseguer, F. Angle-dependent ultrasonic transmission through plates with subwavelength hole arrays. Phys. Rev. Lett. 102, 144301 (2009).
Park, J. J., Lee, K. J. B., Wright, O. B., Jung, M. K. & Lee, S. H. Giant Acoustic Concentration by Extraordinary Transmission in Zero-Mass Metamaterials. Phys. Rev. Lett. 110, 244302 (2013).
Ping Shenga, Jun Meia, Zhengyou Liub, Weijia Wena, "Dynamic mass density and acoustic metamaterials", Physica B: B. Condensed Matter, Proceedings of the Seventh International Conference on Electrical Transport and Optical Properties of Inhomogeneous Media, vol. 394, Issue 2, May 15, 2007, pp. 256-261, 10.1016/j.physb.2006.12.046.
Yang, Z. et al., "Membrane-Type Acoustic Metamaterial with Negative Dynamic Mass", Physical Review Letters, 101, pp. 204301-1-204301-4, (Nov 14, 2008).
Liu, Z. et al., "Locally Resonant Sonic Materials", Science, vol. 289, www.sciencemag.org, pp. 1734-1736, (Sep. 8, 2000).
Fang, N. et al., "Ultrasonic metamaterials with negative modulus", nature materials, vol. 5, pp. 452-456, (Jun. 2006).
Lee, S.H. et al.,"Composite Acoustic Medium with Simultaneously Negative Density and Modulus", Physical Review Letters, 104, pp. 054301-1-054301-4, (Feb. 5, 2010).
Zhang, S. et al., "Focusing Ultrasound with an Acoustic Metamaterial Network", Physical Review Letters, 101, pp. 194301-1-194301-4, (May 5, 2009).
Huang, H.H. et al, "On the negative effective mass density in acoustic metamaterials", International Journal of Engineering Science, 47, pp. 610-617, (2009).

* cited by examiner

ACOUSTIC METAMATERIAL WITH SIMULTANEOUSLY NEGATIVE EFFECTIVE MASS DENSITY AND BULK MODULUS

RELATED APPLICATION(S)

The present patent application claims priority to U.S. Provisional Patent Application No. 61/796,024 filed Nov. 1, 2012, which is assigned to the assignee hereof and filed by the inventors hereof and which is incorporated by reference herein.

BACKGROUND

1. Field

This disclosure relates to acoustic metamaterial that exhibits negative-valued effective mass density and effective bulk modulus in an overlapping frequency regime.

2. Background

Acoustic metamaterials are man-made structures that aim to achieve acoustic/elastic properties which are not available in tradition materials. In particular, negativity in effective dynamic mass density was demonstrated in various different designs. Materials with negative acoustic properties present a negative mass density and bulk modulus, and therefore a negative index of refractivity. Negative effective bulk modulus was also realized in fluid channels with cavity resonators. Other effects such as focusing, image magnifying, acoustic cloaking, total absorption were also realized experimentally. Currently, simultaneous negativity in both effective mass density and bulk modulus was only achieved by a composite structure of membranes and pipe with side-holes.

Current panels do not offer simultaneous negative-valued effective mass density and bulk modulus in acoustics. An existing recipe for acoustic double negativity relies on coupling of two resonating structures. Additionally, a chain of unit cells is required for the demonstration of sufficient effect. Finally, the side-shunting holes are a significant source of dissipation.

SUMMARY

A device with simultaneous negative effective mass density and bulk modulus, has at least one tubular section and front and back membranes sealing the tubular section. The membranes seal the tubular section sufficiently to establish a sealed or restricted enclosed fluid space defined by the tubular section and the membranes, so that the sealing or restriction restricting escape or intake of fluid resulting from acoustic vibrations. A pair of platelets are mounted on the membranes, with each platelet mounted to and substantially centered on respective ones of the front and back membranes.

BRIEF DESCRIPTION OF THE DRAWINGS

FIG. 5A shows the functions for plastic wrap membrane. FIG. 5B shows the functions for Al foil membrane.

FIG. 12 shows the transmission spectrum. FIG. 13 shows the calculated effective parameters.

FIG. 14 shows the calculated transmission coefficient. FIG. 15 shows the calculated effective parameters.

DETAILED DESCRIPTION

Overview

The present disclosure implements a technique that reduces a complex system to a fictitious homogenous material that is characterized by a small set of effective constitutive parameters. This perspective greatly simplifies the description of wave propagation in metamaterials, and also exposes fresh physics and new possibilities for wave manipulations. This approach is used to tackle the problem of double negativity media for of low frequency sound, a traditionally very difficult problem.

The present disclosure describes a type of acoustic metamaterial that can exhibit simultaneously negative effective mass density and bulk modulus in a finite but tunable frequency regime. The described configuration comprises two identical membranes sealing the two opening ends of a hollow cylindrical tube. Two identical platelets of certain rigid material are attached to the center of each said membrane. The two membranes are connected by a second hollow cylinder tube of certain rigid material. It is seen that the low-frequency behavior of the metamaterial is governed by three eigenmodes. A laser vibrometer is used to acquire the displacement fields as well as the relative phases of the two membranes, through which the three modes by their associated symmetry can be unambiguously discriminated. In addition, the effective parameters are extracted directly from the experimentally measured displacement fields. Double negativity in both the effective mass density and effective bulk modulus is found in a frequency regime of 500-800 Hz. In terms of functionality, negative effective mass density can be realized by membrane structures. Negative bulk modulus can be realized using Helmholtz resonators. Making the two effective parameters overlap is not ordinarily achieved in prior art acoustic metamaterials.

An acoustic metamaterial is described that exhibits simultaneously negative effective mass density and bulk modulus in a finite but tunable frequency regime. The design features two elastic membranes augmented by rigid disks or platelets that are placed close together and joined by a rigid ring. The side surface of the structure is enclosed in an air-tight manner. The resultant structure is a resonator that displays double negativity.

The disclosed technology provides an acoustic device that exhibits extraordinary double negativity for low frequency airborne sound.

Structure of Metamaterials

Figure 1A:
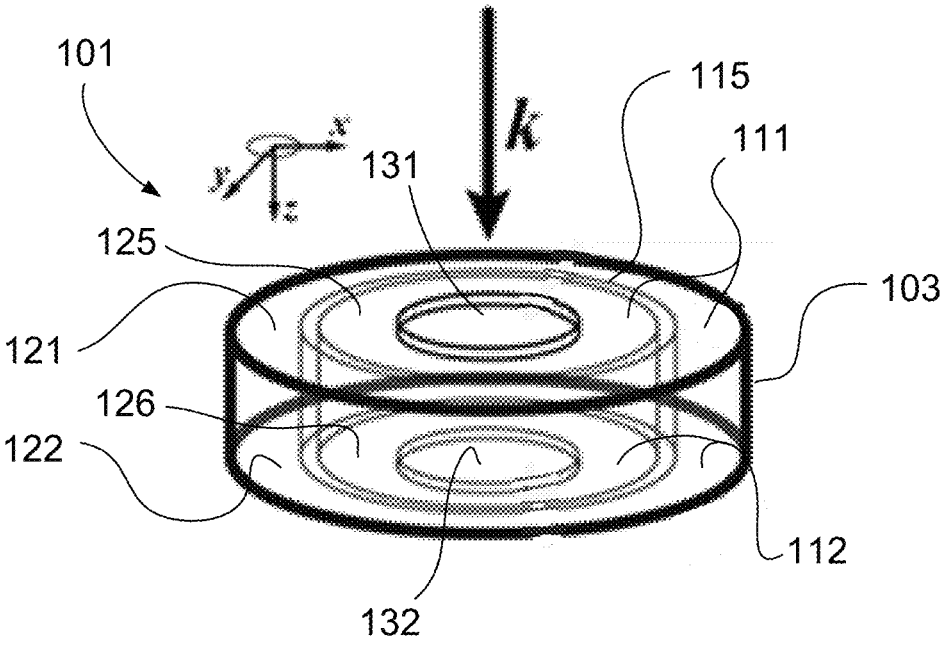
FIGS. 1A and B are schematic depictions of a structural unit in perspective (FIG. 1A) and cross-sectional (FIG. 1B) views.
Figure 1B:
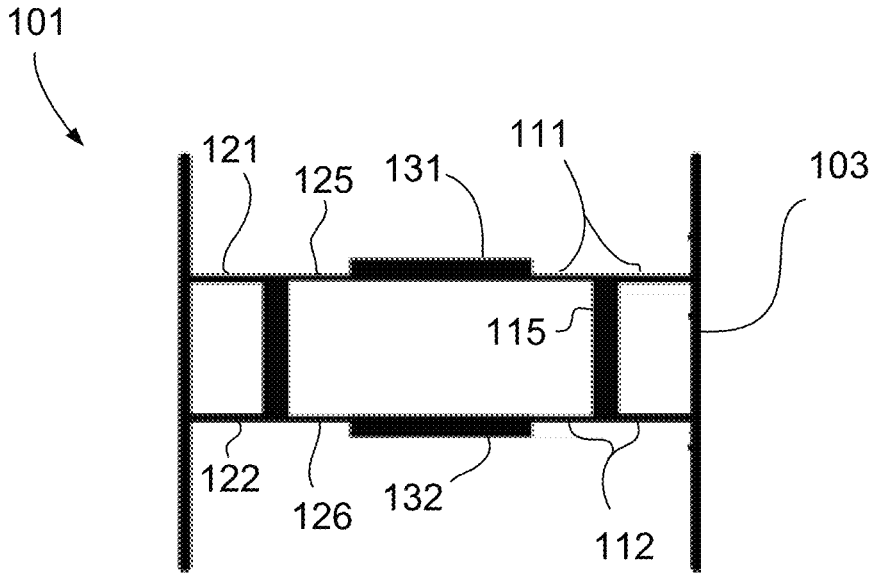

FIGS. 1A and B are schematic depictions of structural unit 101 in perspective (FIG. 1A) and cross-sectional (FIG. 1B) views. The diagrams show a structure of metamaterial that comprises two identical circular membranes. Depicted is outer cylinder 103 supporting two membranes 111, 112. Membranes 111, 112 support inner cylinder 115. Inner cylinder 115 is fixed to membranes 111, 112 which results in membranes 111, 112 forming outer ring portions of the membrane 121, 122 and inner circular portions 125, 126, separated by inner cylinder. A pair of disks or platelets 131, 132 are fixed to respective inner circular portions 125, 126.

By way of non-limiting example, the typical sample here is with total membrane radius R=14 mm (outer ring portion; same as total radius of the membrane), thickness 0.2 mm, and augmented by a circular rigid platelet 131, 132 (radius of 4.5 mm and mass of 159 mg) attached to the center. The two membranes 111, 112 are each fixed to a rigid cylindrical side wall with a radial tensile stress $1.3\times10^6$ Pa. They are connected by a poly(methyl methacrylate) (PMMA) cylinder which forms the inner cylinder 115, which has a thickness of 1.5 mm, inner radius 10 mm and is 6.0 mm in height. The ring 115 has a mass of 395 mg, and the materials parameters of the membranes may include, by way non-limiting example, may be any solid materials, as long as their thickness and elasticity is such that with proper dimensions of cylinders and platelets the structures can give rise to the desired eigenmodes. The amplitude and phase of the transmission and reflection were measured in a modified impedance tube apparatus, comprising two Brüel and Kjær type-4206 impedance tubes with the sample sandwiched in between. The front tube has two sensors, plus a loud speaker at one end to generate a plane wave in the tube. The back tube has one sensor to measure the transmitted wave.

While a cylindrical tube and identical platelets are described, it is possible, within the scope of this disclosure, to use a variation on a cylindrical tube, such as a frustoconical tube or a complex shaped tube. It is also possible to use platelets which are either non-identical but sharing at least one eigenmode or eigenfrequency when mounted on the membrane or non-identical and not sharing an eigenmode or eigenfrequency. It is also possible to select the shape of the tube and/or the sizes of the platelets such that the eigenmodes or eigenfrequencies of the platelets are close but still differing enough to interact with each other as a result of resonant differences.

Figure 2:
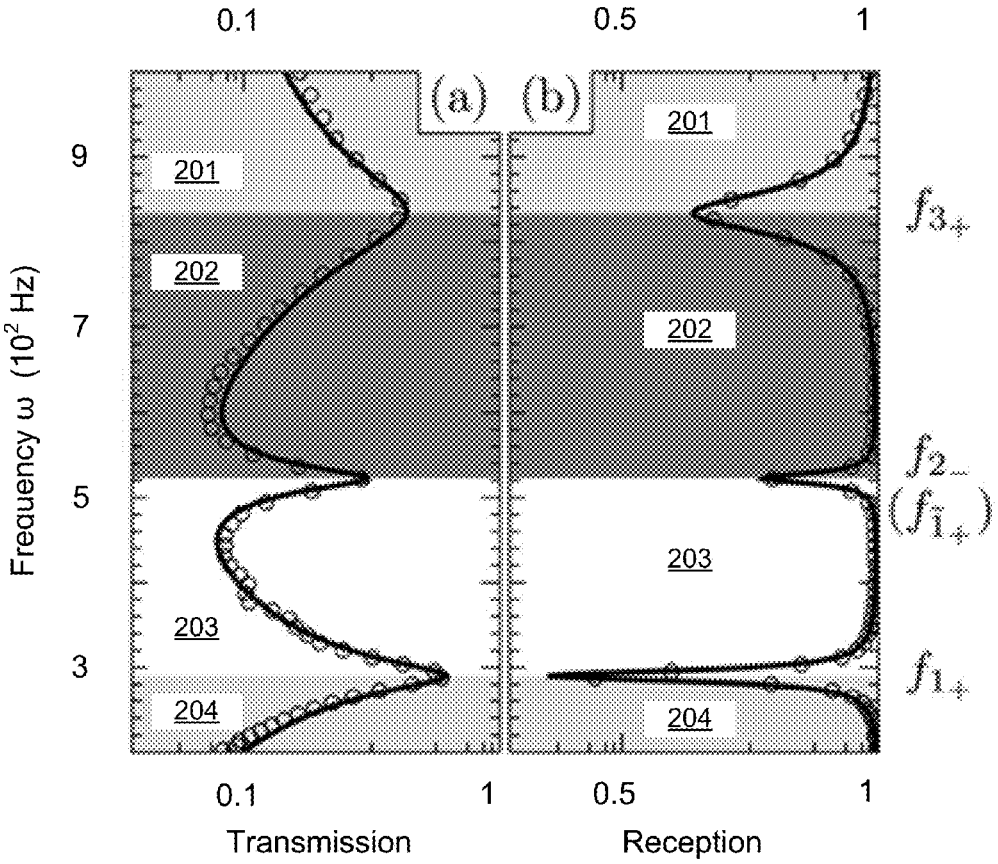
FIG. 2 is a graphic diagram showing calculated and measured transmission and reflection amplitudes. The left side (a) shows transmission amplitude and the right side (b) shows corresponding reflection amplitude.

FIG. 2 is a graphic diagram showing calculated and measured transmission and reflection amplitudes of a sample structural unit 101 constructed according to FIGS. 1A and B. The left side (a) shows transmission amplitude and the right side (b) shows corresponding reflection amplitude. The calculated values are depicted by the solid lines and the measured values are depicted by the circles. Three transmission peaks, located at 290.1 Hz, 522.6 Hz, 834.1 Hz, are seen in both the measured and reflected amplitudes and corresponding peaks occur inversely in the transmission and reflection amplitudes.

The relevant acoustic angular frequency $\omega$ is limited by the condition $2\pi v_0/\omega=\lambda>2R$, where $v_0$=343 msec is the speed of sound in air. Thus we have $\omega<7.79\times10^4$ Hz under this constraint. An immediate consequence is that as far as the radiation modes are concerned, i.e., transmission and reflection, the system may be accurately considered as one-dimensional. This can be seen as follows. The normal displacement u of the membrane may be decomposed as $u=\langle u\langle+\delta u$, where $\rangle u\rangle$ represents the piston-like motion of the membrane (with $\langle\ \rangle$ representing surface averaging) and $\delta u$ the fine details of the membrane motion. In the air layer next to the membrane surface, the acoustic wave must satisfy the dispersion relation $k_{\parallel}^2+k_{\perp}^2=(2\pi/\lambda)^2$, where $k_{\parallel/(\perp)}$ represents the wave vector component parallel (perpendicular) to the membrane surface. Since the two dimensional fine pattern of $k_{\parallel}$ can be described by a linear superposition of $k_{\parallel}$'s, all of which must be greater than $2\pi/2R>2\pi/\lambda$, it follows that the relevant $k_{\perp}^2<0$. That is, the displacement component $\delta u$ leads only to evanescent, non-radiating modes. The displacement component $\langle u\langle$, on the other hand, has $k_{\parallel}$ components peaked at $k_{\parallel}=0$; hence it is coupled to the radiation modes.

Figure 3A:
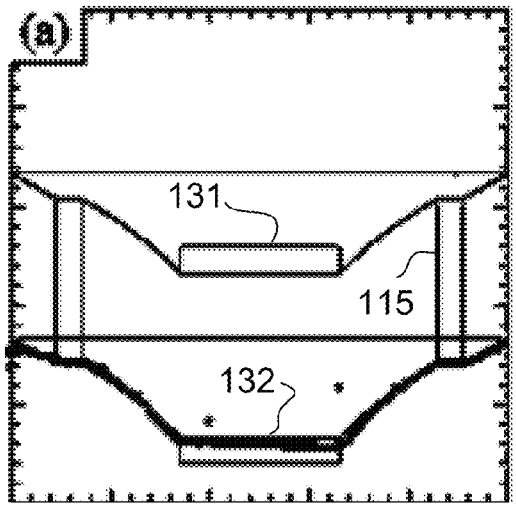
FIGS. 3A-C are graphic images showing displacement of the metamaterials of FIGS. 1A and B in one-dimensional imagery.
Figure 3B:
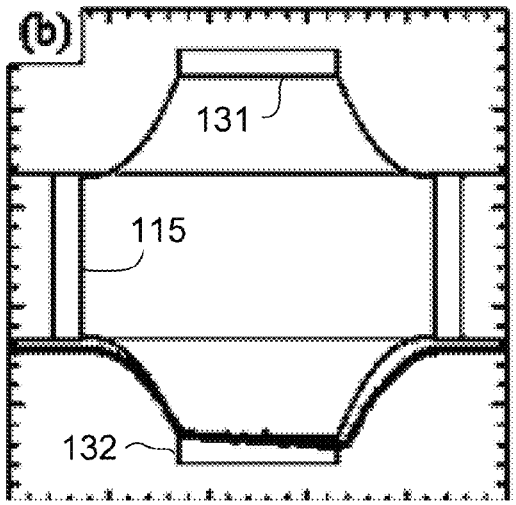
Figure 3C:
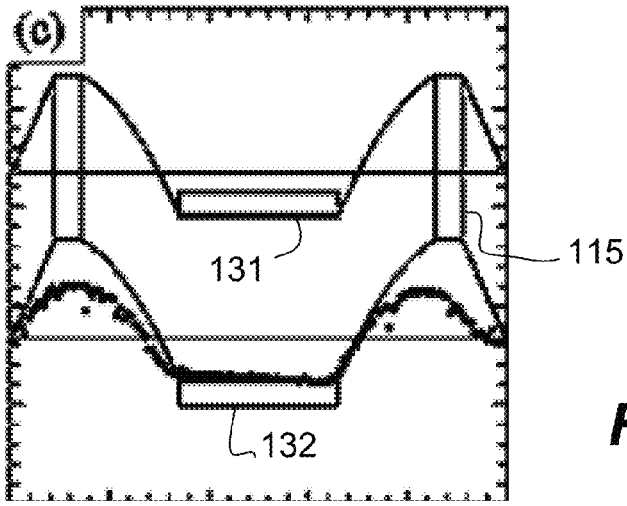

FIGS. 3A-C are graphic images showing displacement of the metamaterials forming the structural unit 101 of FIGS. 1A and B, depicted in one-dimensional imagery. The images show measured (circles or blocks) and calculated (curves) displacement profiles of the metamaterial at three eigenfrequencies.

Simplification to a one-dimensional system greatly facilitates the visualization of the relevant symmetries of the two types of resonances, involving either the in-phase or the out-of-phase motion of the two membranes. An important element of the experimental measurements is the use of laser vibrometer (Graphtec AT500-05) to map the normal displacement across the membrane on the transmission side, plus the relative phases of the two membranes. For simplicity, this relative phase can be detected by the relative motion between the two platelets. In FIG. 2 it is shown that three displacement fields of the coupled-membrane system at the transmission peaks, i.e., resonance frequencies ($\omega_{1_+}$=290.1 Hz, $\omega_{2_-}$=522.6 Hz, and $\omega_{3_+}$=834.1 Hz). The continuous curves delineate the simulated results by using the COMSOL Multiphysics finite element package, whereas the circles represent the measured results using laser vibrometer. Excellent agreement is seen. For the first mode, both membranes oscillate in unison, carrying the ring together in a translational motion. For the second eigenmode, the ring is motionless and only the membranes vibrate. Since the PMMA ring is rather rigid, it is impossible for the soft membrane to compress the ring at such low frequencies. Consequently, the ring acts like an anchor, and the central portions of the two membranes vibrate in an out-of-phase manner. For the third eigenmode, the ring and the platelets vibrate in opposite phase. It is seen that the simulated phase relation between the two platelets agrees with the experimental results almost perfectly.

While the first and third eigenmodes are clearly dipolar in character and hence mass-density-type (MDT), the second mode has the monopolar symmetry and hence bulk-modulus-type (BMT). For the dipolar resonance, the total mass of the ring and the platelets serves as the most important parameter for tuning its frequency. For the monopolar resonance, the membranes' separation and transverse dimension are the crucial parameters. The fourth eigenmode is noted to be at a much higher frequency of 2976.3 Hz. Its effect in the frequency range of interest was minimal, and thereby ignored in the following analysis.

The average displacement of the two coupled membranes may be denoted by $\langle\vec{w}\langle=[\langle u(x_0)\langle,\langle u(-x_0)\langle]$, where $-x_0$ and $x_0$ denote the positions of the two membranes. $\langle\vec{w}\langle$ can be decomposed into two distinct modes discriminated by symmetry, i.e., $\langle\vec{w}\langle=\xi\langle\vec{w}\langle_+\pm\eta\langle\vec{w}\rangle_-$. Here $\xi$ and $\eta$ are arbitrary coefficients. Symmetric mode $\rangle\vec{w}\rangle_+$ denotes the motion in which the two membranes move in unison, i.e., $\rangle u(x_0)\rangle=\rangle u(-x_0)\rangle$. Anti-symmetric mode $\rangle\vec{w}\rangle_-$ is characterized by $\rangle u(x_0)\rangle=-\rangle u(-x_0)\rangle$, i.e., the two membranes moving out of phase with each other.

The two relevant effective material parameters are the dynamic mass density $\bar{\rho}$ (associated with the symmetric mode) and the effective bulk modulus $\bar{\kappa}$ (associated with the anti-symmetric mode). To extract these two effective parameters, a homogenization scheme is established, based on the fact that the behavior of the system is dictated by the resonant eigenmodes. The scheme needs only the 3 relevant eigenfunctions to delineate the correlated motions on the two ends (i.e., the two membranes). This aspect is distinct from the homogenization schemes in which matching the response of the entire frequency range of interest is required.

Consider the eigenfunction expansion of Green's function:

$$G(\vec{x},\vec{x}') = \sum_{\alpha} \frac{u_\alpha^*(\vec{x})u_\alpha(\vec{x}')}{\rho_\alpha(\omega_\alpha^2 + i\omega\beta_\alpha - \omega^2)} \quad \text{(equation 1)}$$

where $\rho_\alpha \equiv \int_\Omega u_\alpha^*(\vec{x})\rho(\vec{x})u_\alpha(\vec{x})d\vec{x}$ denotes the averaged mass density for the $\alpha^{th}$ eigenfunction $u_\alpha(\vec{x})$, and $\omega_\alpha$ and $\beta_\alpha$ are the resonant frequency and dissipation coefficient that can be experimentally determined. By using the experimentally measured eigenfunctions, as shown in FIGS. 3A-3C, the relevant $\rho_\alpha$ can be evaluated. On the other hand, the dissipation coefficients $\beta_\alpha$ are determined by comparing the magnitudes of the measured and simulated eigenfunctions. For the frequency range of interest, it turns out that only three eigenfunctions are needed, i.e., $\alpha$ ranges from 1 to 3 only. We are interested in the cross-sectional averaged motion of the two membranes. By carrying out the cross-sectional average on G, we obtain $$\langle G(x_0, \pm x_0)\rangle = \sum_{\alpha=1}^{3} \frac{\langle u_\alpha^*(x_0)\rangle\langle u_\alpha(\pm x_0)\rangle}{\rho_\alpha(\omega_\alpha^2 + i\omega\beta_\alpha - \omega^2)}, \quad \text{(equation 2)}$$

where the two coordinates are now specified at the positions of the two coupled membranes. $\langle G\rangle$ can always be decomposed into a symmetric component $\bar{G}_+$ and an anti-symmetric component $\bar{G}_-$, where $$\bar{G}_\pm = \langle G(x_0, x_0)\rangle \pm \langle G(x_0, -x_0)\rangle = \sum_{\alpha=1}^{3} \frac{\langle u_\alpha^*(x_0)\rangle[\langle u_\alpha(x_0)\rangle \pm \langle u_\alpha(-x_0)\rangle]}{\rho_\alpha(\omega_\alpha^2 + i\omega\beta_\alpha - \omega^2)} \quad \text{(equation 3)}$$

Now consider a homogeneous one-dimensional system of length $2x_0$. Green's function of such a one-dimensional system is uniquely determined by the two material parameters $\bar{\rho}$ and $\bar{\kappa}$. In particular, we can have the similar quantities $\bar{G}_\pm^{(1D)}$ that are given by the formulas:

$$\bar{G}_+^{(1D)} = -\frac{\cot\left(x_0\omega\sqrt{\bar{\rho}}/\sqrt{\bar{\kappa}}\right)}{\omega\sqrt{\bar{\rho}}\sqrt{\bar{\kappa}}}, \quad \text{(equation 4a)}$$

$$\bar{G}_-^{(1D)} = -\frac{\tan\left(x_0\omega\sqrt{\bar{\rho}}/\sqrt{\bar{\kappa}}\right)}{\omega\sqrt{\bar{\rho}}\sqrt{\bar{\kappa}}} \quad \text{(equation 4b)}$$

By requiring $\bar{G}_\pm = \bar{G}_\pm^{(1D)}$, we obtain two equations which determines $\bar{\rho}$ and $\bar{\kappa}$ as a function of frequency.

Figure 4:
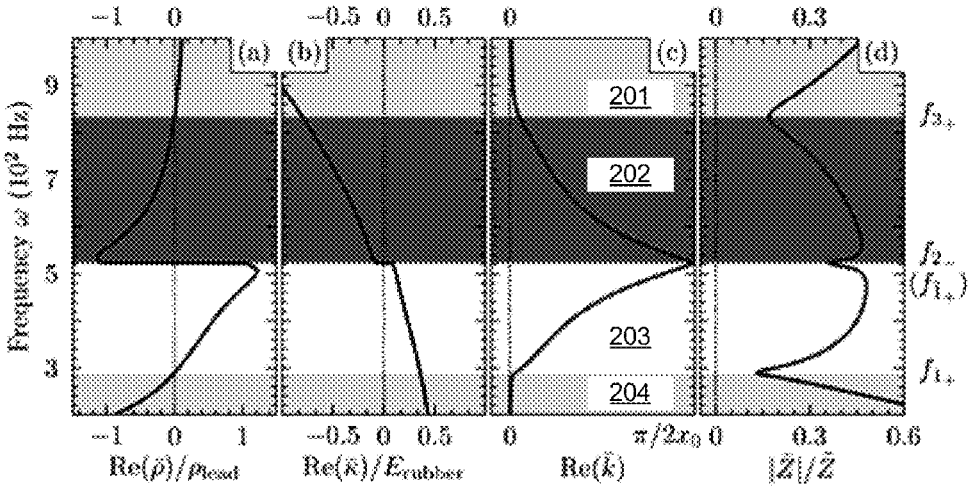
FIG. 4 is a graphic diagram showing properties of materials described by Green's function.

FIG. 4 is a graphic diagram showing properties of the materials described by Green's function. The properties depicted are the real part of effective mass density, shown in panel (a), real part of effective bulk modulus, shown in panel (b), real part of effective wave vector, shown in panel (c), and the magnitude of the effective impedance of the metamaterial, shown in panel (d). Since there can be multiple solutions to (equation 4), the solution branch with the longest wavelength is selected. The results are shown in FIG. 4, at curves (a) and (b). For the purpose of clarity, only the real parts of the effective parameters are plotted. The darkly shaded frequency range denotes the double negativity regime.

From $\bar{\rho}$ and $\bar{\kappa}$, we can use the transport matrix method to calculate the transmission and reflection coefficients T and R from the one-dimensional model. The results are displayed in FIG. 2 as solid curves. They agree remarkably well with experimental results, even beyond the usual long wavelength regime (e.g., around $\omega_{1_+}$ and $\omega_{2_-}$).

The transmission properties of the metamaterial are determined by two factors: impedance matching with air and the values of effective wave-vectors. We note that $\bar{\rho}$ crosses zero precisely at the two eigenfrequencies $\omega_{1_+}$ and $\omega_{3_+}$, as depicted in FIG. 4, at curve (a), arising from the dipolar resonances. A direct consequence is that the effective impedance $$|\bar{Z}| = \left|\sqrt{\bar{\rho}\bar{\kappa}}\right|,$$

as depicted in FIG. 4, at curve (d), matches well with the background air. Two transmission peaks, accompanied by reflection minima shown in FIG. 2 (right side), are seen at $\omega_{1_+}$ and $\omega_{3_+}$. The anti-resonance frequency, represented by $\omega_{1_+}$, is between the two MDT eigen-frequencies. The anti-resonance is due to the out-of-phase hybridization of the two neighboring MDT eigenmodes that leads to $\langle\vec{w}\rangle_+=0$, at which point $\bar{\rho}$ must diverge.

To simplify the picture, the BMT frequency $\omega_{2_-}$ has been tuned to coincide with the anti-resonance $\omega_{1_+}$ (within several Hertz). Due to the monopolar resonance, the volumetric pulsation (anti-symmetric motion) is large, thereby leading to a small but finite $\bar{\kappa}$. (In the absence of loss, namely $\beta_{2_+}=0$, $\bar{\kappa}$ vanishes at $\omega_{2_-}$.) The calculation shows that because of the large $\bar{\rho}$, $|\bar{Z}|$ still takes a very large value, and consequently the impedance mismatches with air. This raises the question of why we see a transmission peak at this frequency, instead of a dip. The reason lies in the effective wave-vector $\bar{k}$, depicted in FIG. 4 at curve (c), which takes the value of $\bar{k}=\pi/2x_0$ at $\omega_{2_}$, with $2x_0$ being the thickness of the metamaterial (as well as the homogenized slab). This indicates that the effective wavelength $\bar{\lambda}=2\pi/\bar{k}=4x_0$, is twice the thickness of the slab. As a result, Fabry-Perot-like multiple reflections of the wave inside the slab constructively interferes at the transmission end of the homogenized slab, eventually enhancing the overall transmission.

The key frequencies discussed above: $\omega_{1_+}$, $\omega_{1_+}$, $(\omega_{2_})$, and $\omega_{3_+}$, divide the spectrum into two passbands. The first one is a conventional double-positive band, found in $\omega\epsilon(\omega_{1_+}, \omega_{1_+}(\omega_{2_}))$. This is depicted in FIGS. 2 and 4 as the white regions 203 (third band from the top). The second one, residing in $\omega\epsilon(\omega_{1_+}(\omega_{2_}), \omega_{3_+})$ is due to the overlapping of the negative $\bar{\rho}$ and negative $\bar{\kappa}$ bands. This is depicted in FIGS. 2 and 4 as the darkly shaded regions 202 (second band from the top). In the doubly negative frequency regime, the instantaneous acceleration of the homogenized medium is always opposing the external excitation. In the meantime, it is expanding upon compression, and contracting upon release. Medium with such properties can support the propagation of acoustic wave, since effective wave-vector $$\bar{k} = \omega\sqrt{\bar{\rho}/\bar{\kappa}}$$

is real. This is depicted in FIG. 4C. Its response is out-of-phase to the double-positive medium, which is demonstrated in the negative group velocity as can be seen from the slope of the dispersion in FIG. 4C.

Single-negative bandgaps are found in two regimes: $\omega<\omega_{1_+}$, and $\omega>\omega_{3_+}$. This is depicted in FIGS. 2 and 4 as the lightly shaded regions 201, 204 (top and bottom bands). The first gap is due to negative-valued $\bar{\rho}$, whereas the second gap is due to the negative $\bar{\kappa}$. Single-negativity in the effective parameters gives rise to pronounced imaginary part of the effective wave-vectors within the bandgaps, so that the acoustic wave must be evanescent. Here, the transmission coefficients within the band gaps are not necessarily small. This is due to the relatively long decay length, given by $d=\mathrm{Im}(\bar{k})^{-1}$. The minimum of d is around 13 mm, which is still larger than the thickness of the material. Hence the sound wave is penetrative.

Alternative Membrane Materials

The membranes used in the structures in this invention can in fact be of any solid materials, as long as their thickness and elasticity is such that with proper dimensions of cylinders and platelets the structures can give rise to the desired eigenmodes. This is because Hook's law of elasticity is generally held for any solid membranes as long as they are held tightly but not necessarily pre-stressed. It should preferably be crease-free but the functionality does not go away if the amount of creases or wrinkle is small. They are just imperfections caused by imperfect fabrication processes. The membrane can have thickness variation across the cell, as the general principle still applies.

Figure 5A:
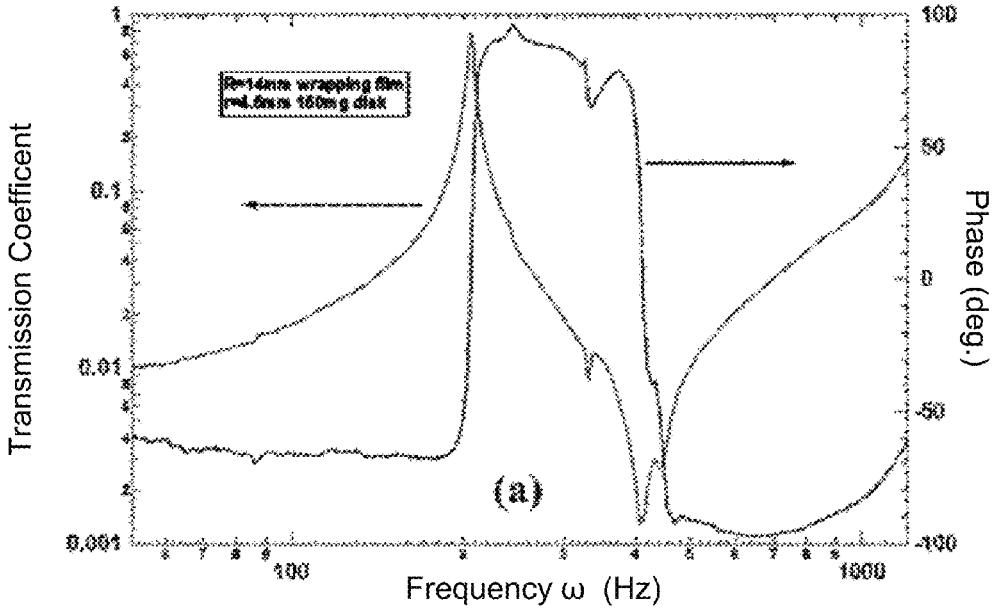
FIGS. 5A and 5B are graphical depictions representing experimental transmission amplitude (left axis) and phase (right axis) as a function of frequency.
Figure 5B:
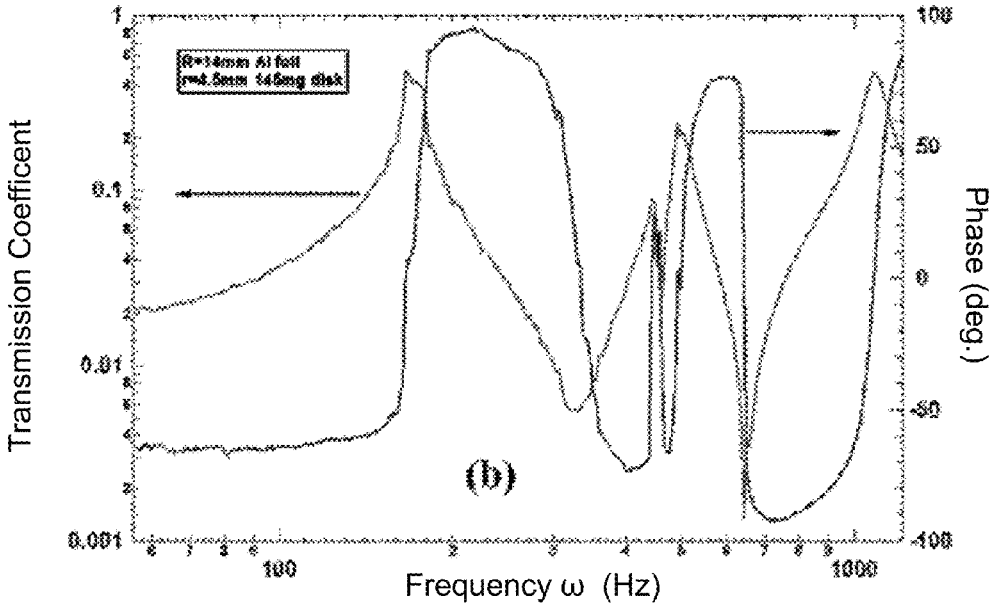

FIGS. 5A and 5B are graphical depictions representing experimental transmission amplitude (left axis) and phase (right axis) as a function of frequency for (FIG. 5A) plastic wrap membrane, and (FIG. 5B) Al foil membrane. Both types of membranes are the familiar types of materials frequently used for food packaging in home kitchens, e.g., 0.1 mm thick by way of non-limiting example.

Both spectra exhibit typical transmission minimum anti-resonances between two transmission maximum resonances. The anti-resonance principle for the occurrence of transmission minimum works in structures containing membranes made of solids other than rubber. The aluminum foil was held tightly but not pre-stressed. The basic unit of the structures of the disclosed technology is the fixed membrane plus weight structure, and so if the basic properties of such structure are the same regardless of the type of materials used as membrane, it is possible to construct the disclosed structures using materials other than rubber for the elastic membranes and without pre-stress.

Figure 6A:
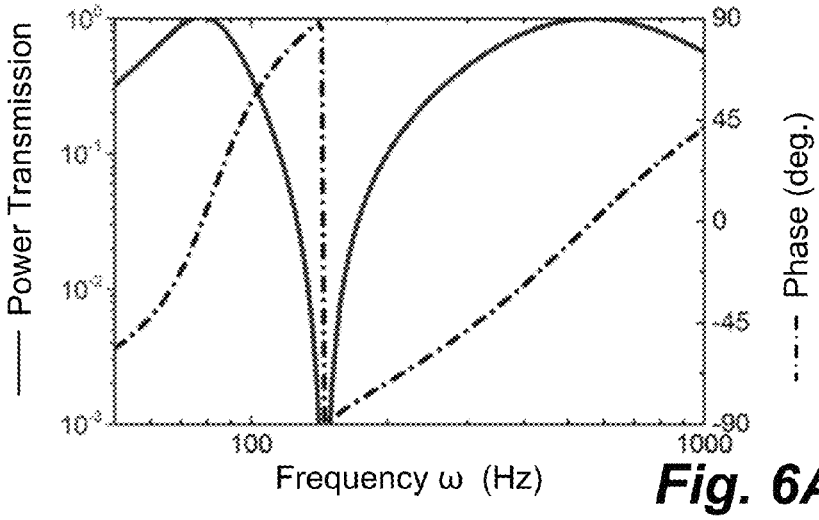
FIGS. 6A and B are graphical depictions of numerical simulations of the structures with Acrylonitrile Butadiene Styrene (ABS) membranes having different dimensions.
Figure 6B:
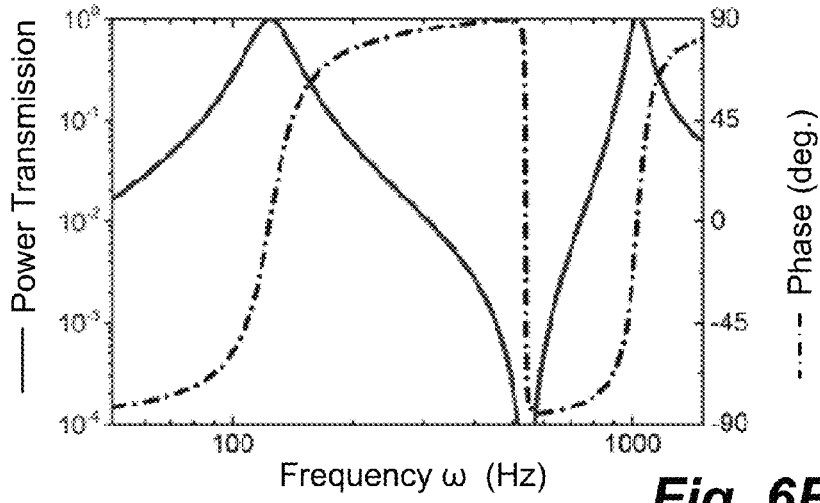

FIGS. 6A and B are graphical depictions of numerical simulations of the structures with Acrylonitrile Butadiene Styrene (ABS) membrane. FIG. 6A depicts a simulation with an ABS membrane radius=50 mm, thickness=0.1 mm, Pb weight radius=8 mm, thickness=1.1 mm. FIG. 6B depicts a simulation with an ABS membrane radius=100 mm, thickness=0.5 mm, ABS weight radius=40 mm, thickness=2.25 mm.

Figure 7:
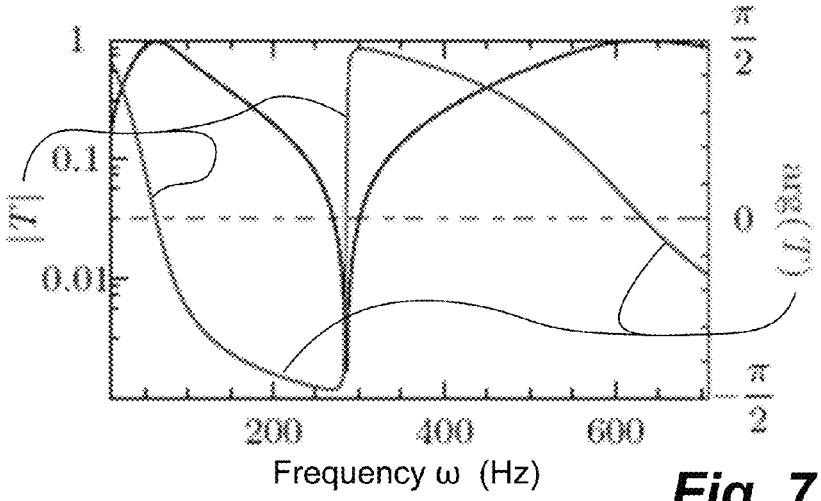
FIG. 7 is a graphical depiction showing numerical simulations of an all-aluminum structure.
Figure 8A:
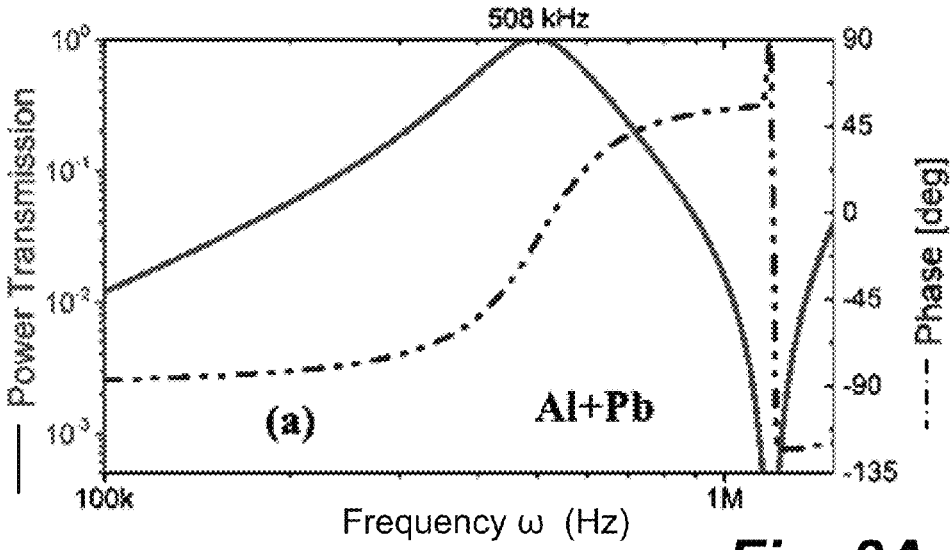
FIGS. 8A and B are graphical depictions of numerical simulations of structures with working frequencies in the ultrasound regime with membranes having different dimensions.
Figure 8B:
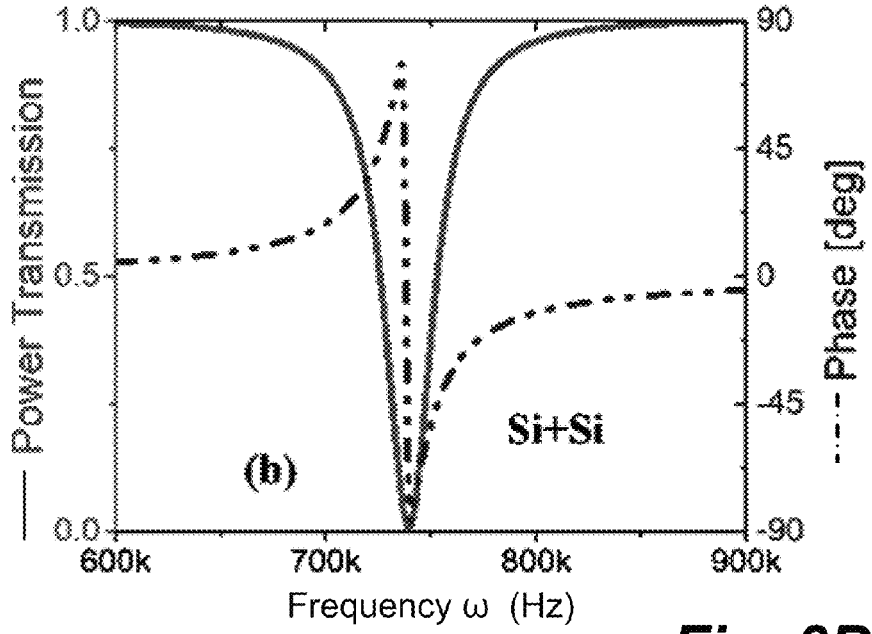

FIGS. 6A and B and FIG. 7 show numerical simulation transmission spectra for the structures with an acrylonitrile butadiene styrene membrane and an aluminum membrane, respectively. These membranes behave according to the experimental results depicted in FIGS. 5A and B. FIGS. 8A and 8B shows numerical simulation transmission spectra for the structures with working frequency in the ultrasound regime. It is evident that by adjusting the design parameters one can cover a much wide frequency range. As the eigenfrequencies of the basic structure can be changed by adjusting the dimensions and materials used over a wide frequency range, it is possible to construct the disclosed structures for use in other frequency ranges, such as ultrasound.

FIG. 7 is a graphical depiction showing numerical simulations of an all-aluminum structure. Membrane radius=50 mm, thickness=0.1 mm, weight radius=20 mm, thickness=0.1 mm.

FIGS. 8A and B are graphical depictions of numerical simulations of structures with working frequencies in the ultrasound regime. FIG. 8A depicts a simulation with Al membrane radius=0.5 mm, thickness=0.1 mm, Pb weight radius=0.15 mm, thickness=0.1 mm. FIG. 8B depicts a simulation with Si membrane radius=0.5 mm, thickness=0.1 mm, Si weight radius=0.2 mm, thickness=0.3 mm.

Structure with Cylinder Suspended by Primary Membrane

Figure 9:
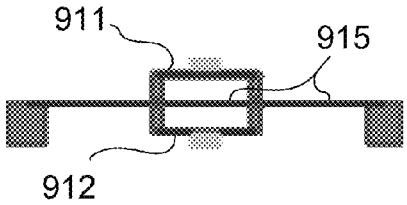
FIG. 9 is a schematic drawing showing an alternate structures in which two smaller hollow cylinders are attached onto the middle of the large membrane, one on each side.
Figure 10:
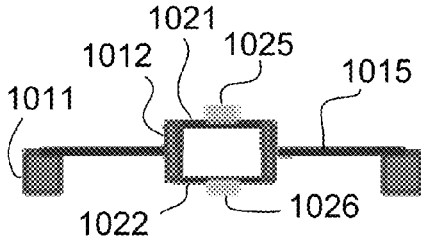
FIG. 10 is a schematic drawing showing an alternate structure having an outer cylinder supporting an inner cylinder suspended by a membrane supported by an outer cylinder.

FIGS. 9 and 10 are schematic drawings showing two alternate structures. The alternative structures are both characterized by a large and rigid hollow cylinder with a large elastic membrane attached, and with a smaller cylinder arrangement supported by the large elastic membrane. In the configuration of FIG. 9, two smaller hollow cylinders 911, 912 are attached onto the middle of the large membrane 915, one on each side. A smaller elastic membrane is attached to the open end of each smaller cylinder. Finally, a rigid platelet is attached onto the center of each smaller membrane. The two smaller cylinders can be separate, and joined through the membrane, or can be a single cylinder, with the membrane separating the single cylinder into two halves.

FIG. 10 is a schematic drawing showing an alternate structure having an outer cylinder 1011 supporting an inner cylinder 1012 suspended by membrane 1015 supported by outer cylinder 1011. The alternative structure is characterized by a hollow cylinder with both ends sealed by elastic membranes 1021, 1022. A platelet 1025, 1026 is attached onto the center of each membrane 1021, 1022. The whole sub-structure is then attached to larger hollow cylinder 1011 by membrane 1015, which is separate from membranes 1021, 1022. This results in an interruption in the continuity of the large elastic membrane within the smaller cylinder arrangement. The configuration of FIG. 10 is similar to that of FIG. 9, except that the smaller cylinder arrangement is configured as a single cylinder.

In one non-limiting example, for each of the configurations of FIGS. 9 and 10, the inner diameter of the large cylinder and the large membrane is 20 mm, while that of the smaller cylinder and membrane is 14 mm. The thickness of the membranes is 0.20 mm, and they are made of rubber. The wall thickness of the small cylinders is 0.5 mm, and its height is 1.5 mm. The diameter of the platelet is 4 mm, its thickness 0.2 mm. The mass density of the cylinders is 1.0 g/cm$^3$, while that of the platelet is 13.6 g/cm$^3$.

In one non-limiting example, the large cylinder in either of FIG. 9 or 10 has an inner diameter of 20 mm, with the diameter of the large membrane being the same. The inner diameter of the smaller cylinders and the diameters of their membranes is 12 mm. In this example, the thickness of the membranes is 0.20 mm, and they are made of rubber. The wall thickness of the small cylinders is 0.5 mm, and their height is 1.0 mm. The diameter of the platelet is 4 mm, its thickness 0.4 mm. The mass density of the cylinders is 1.0 g/cm$^3$, while that of the platelet is 13.6 g/cm$^3$.

Figure 11A:
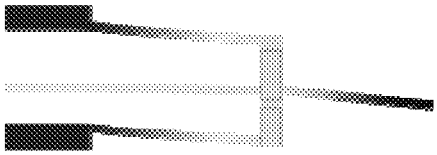
FIG. 11A-D are diagrams showing eigenmodes of the example alternate structure of FIG. 9.
Figure 11B:
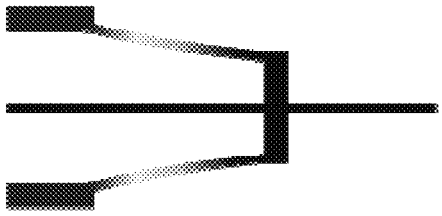
Figure 11C:
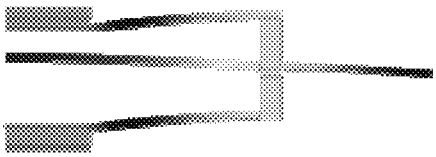
Figure 11D:
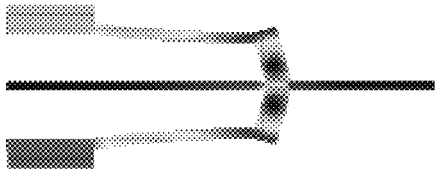

FIGS. 11A-D are diagrams showing eigenmodes of the example alternate structure of FIG. 9 having the 20 mm large cylinder and the 12 mm smaller cylinders. Numerical simulations show that such structure has two dipole-like eigenmodes and one monopole-like eigenmode. The lowest mode-1 is dipole-like at 227 Hz (FIG. 11A), followed by the monopole mode-2 at 341 Hz (FIG. 11B). The second dipole-like mode-3 is at 581 Hz (FIG. 11C), and the anti-resonance formed by mode-1 and -3 is at 447 Hz (FIG. 11D). The sequence of eigenmodes and anti-resonance of this structure is the same as the structure shown in FIG. 1. It is therefore expected that a wide frequency band will exist within which both the effective mass and modulus are negative; i.e., there is a double negativity region.

Figure 12:
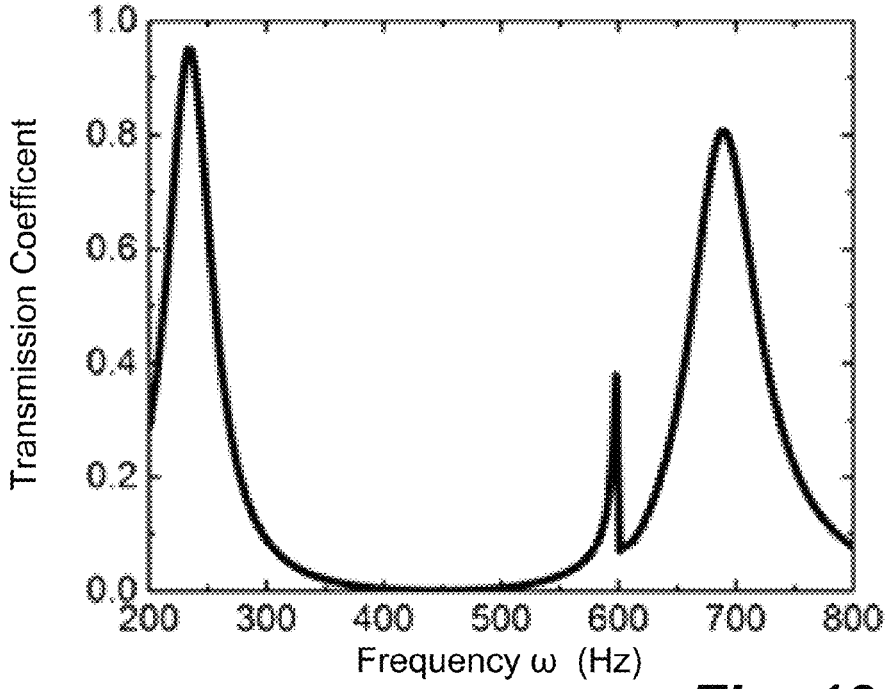
FIGS. 12 and 13 are graphical depictions of calculated transmission coefficient and effective parameters for the structure of FIG. 9.
Figure 13:
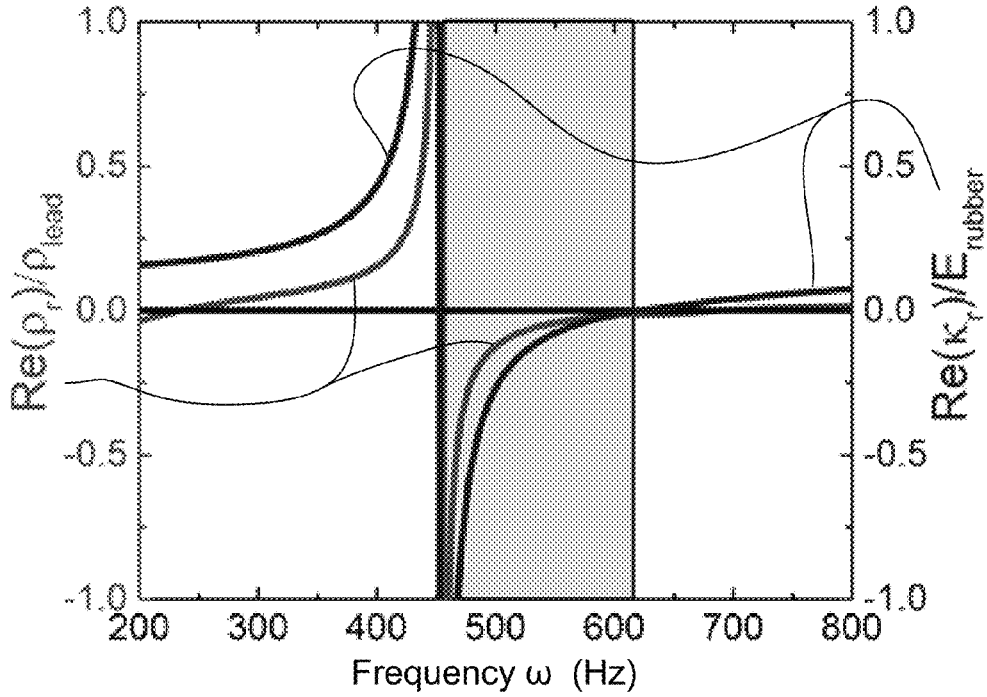

FIGS. 12 and 13 are graphical depictions of calculated transmission coefficient and effective parameters for the structure of FIG. 9. The transmission spectrum (FIG. 12) and band diagram (FIG. 13) of the configuration of FIG. 9 were obtained by numerical simulations. The shaded area denotes the double negative region. There is such a band between 450 Hz and 620 Hz, as shown by the shaded area in FIG. 13.

Figure 14:
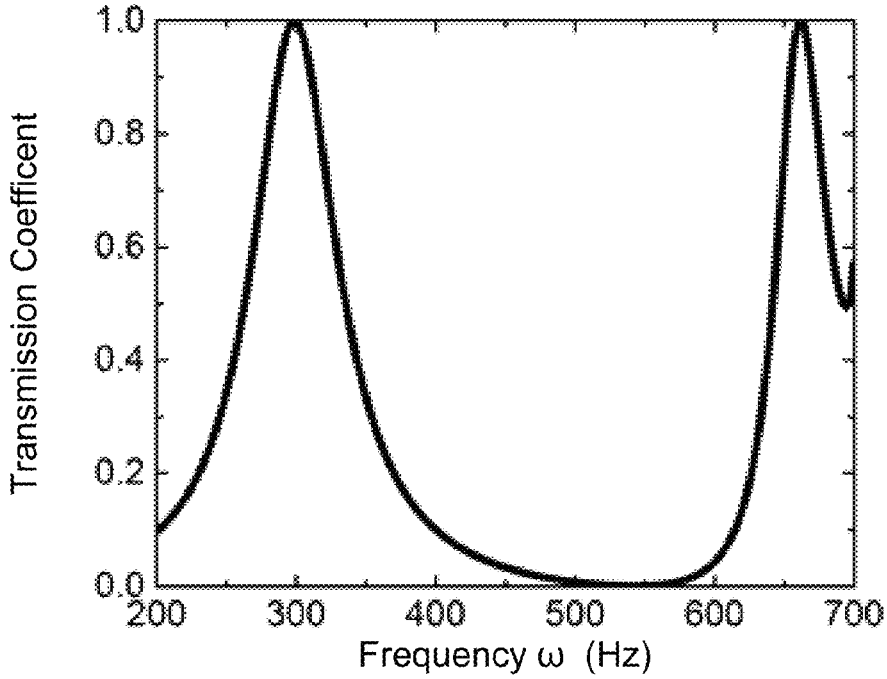
FIGS. 14 and 15 are graphical depictions of calculated transmission coefficient and effective parameters for the structure of FIG. 10.
Figure 15:
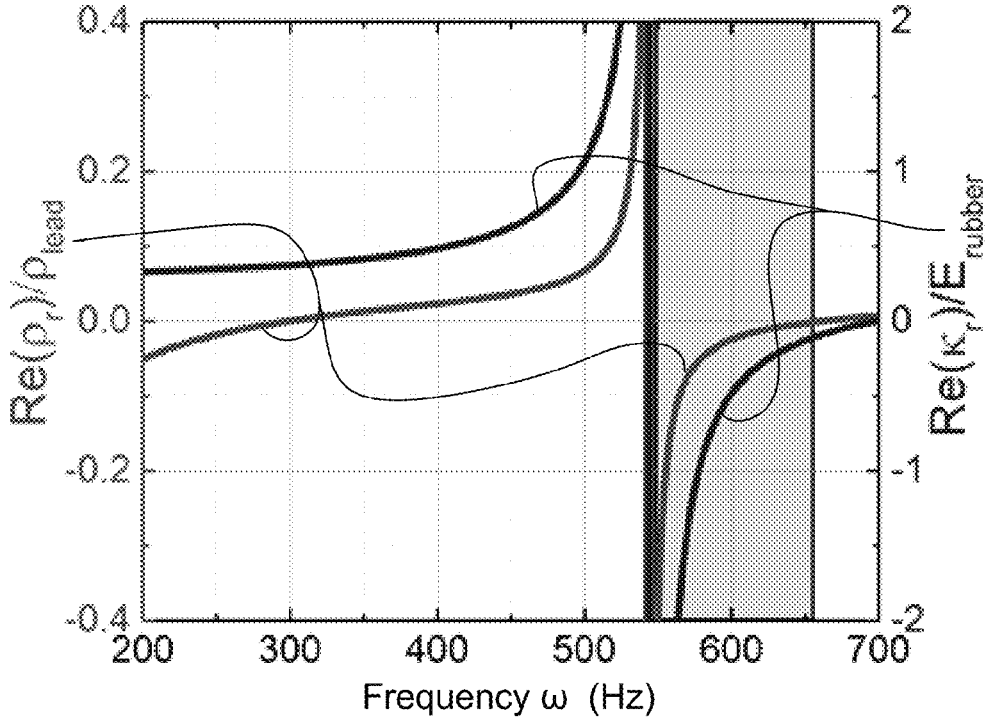

In the configuration of FIG. 10, the single hollow cylinder is attached onto the middle of the large membrane. FIGS. 14 and 15 are graphical depictions of calculated transmission coefficient and effective parameters for the structure of FIG. 10. The shaded area denotes the double negative region. Numerical simulations show that this structure has two dipole-like eigenmodes and one monopole-like eigenmode, similar to that of the first alternate structure (FIG. 9), and as such, the eigenmodes are as reflected in FIG. 11A-D. The lowest mode-1 is dipole-like at 299 Hz, as depicted in FIG. 11A, followed by the monopole mode-2 at 341 Hz, as depicted in FIG. 11 11B. The second dipole-like mode-3 is at 662 Hz, as depicted in FIG. 11C, and the anti-resonance formed by mode-1 and -3 is at 540 Hz, as depicted in FIG. 11D. The sequence of eigenmodes and anti-resonance of this structure is the same as for the configuration of FIG. 9. It is therefore expected that a wide frequency band within which both the effective mass and modulus are negative; i.e., there is a double negativity region. The calculated transmission coefficient and effective parameters are given in FIGS. 14 and 15. There is such a band between 450 Hz and 620 Hz, as shown by the shaded area in the FIG. 15.

Hierarchical Self-Similar Architecture

Figure 16:
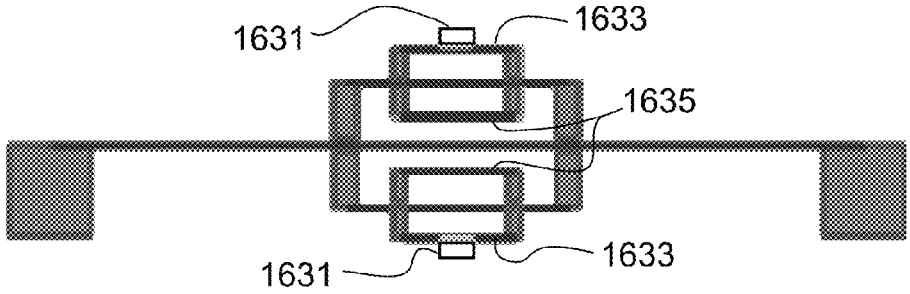
FIG. 16 is a schematic diagram showing a two-level hierarchically scaled repeating architecture based on the configuration of FIG. 9.

The structures of FIGS. 9 and 10 can be made into a hierarchically scaled repeating architectures that can possess a range of interesting acoustic characteristics. FIG. 16 is a schematic diagram showing a two-level hierarchically scaled repeating architecture based on the configuration of FIG. 9, depicting platelets 1631 mounted on membranes 1633. In this arrangement, the configuration of FIG. 9 can be viewed as the basic unit of the hierarchically scaled repeating architecture. In the depicted configuration, platelets 1631 are on the outer membranes 1633 but not on inner membranes 1635.

Figure 17:
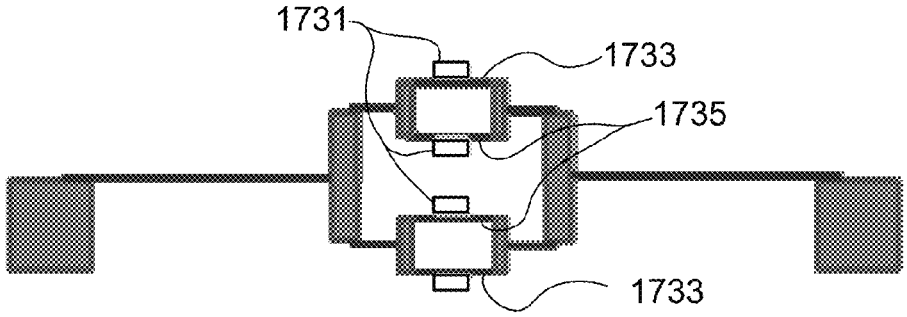
FIG. 17 is a schematic diagram showing a two-level hierarchically scaled repeating architecture based on the configuration of FIG. 10.

Similarly, FIG. 17 is a schematic diagram showing a two-level hierarchically scaled repeating architecture based on the configuration of FIG. 10, with the configuration of FIG. 10 viewed as the basic unit of the hierarchically scaled repeating architecture. In the depicted configuration, platelets 1731 are on both outer and inner membranes 1733, 1735.

Figure 18:
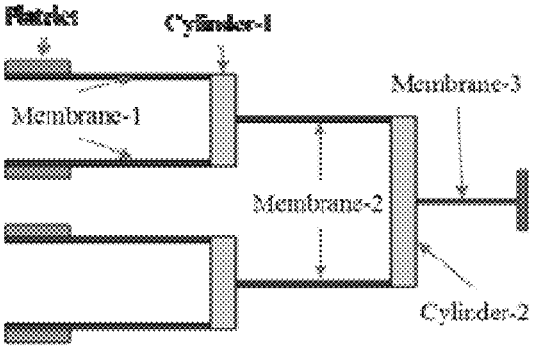
FIG. 18 is a diagram modeling the hierarchically scaled repeating architecture of FIG. 17, and is used in eigenmode representation.
Figure 19A:
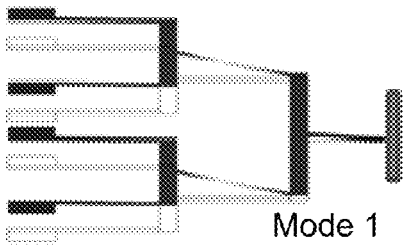
FIGS. 19A-G are diagrams showing the eigenmodes obtained by numerical simulations of the structure in FIG. 17.
Figure 19B:
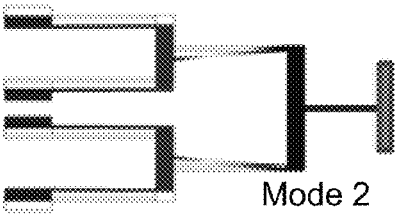
Figure 19C:
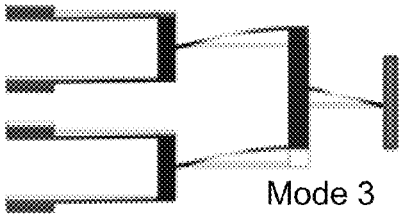
Figure 19D:
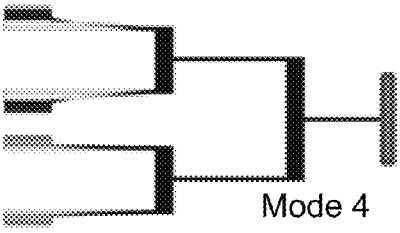
Figure 19E:
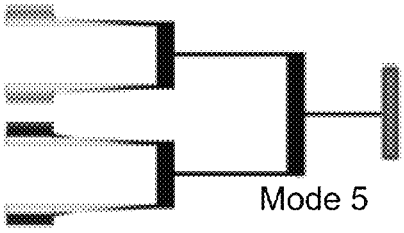
Figure 19F:
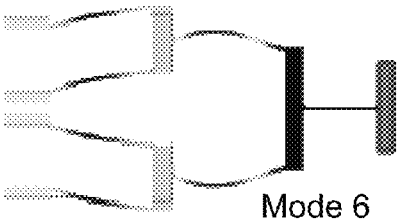
Figure 19G:
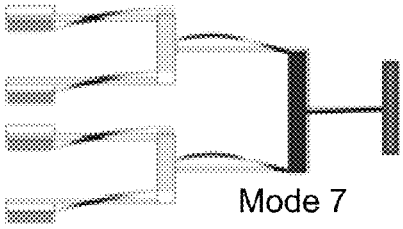

FIG. 18 is a diagram modeling the hierarchically scaled repeating architecture of FIG. 17, and is used in eigenmode representation. FIGS. 19A-G are diagrams showing the eigenmodes obtained by numerical simulations. In the examples, platelets 1631, 1731 (shown in FIGS. 16 and 17) are positioned on the lowest hierarchical level, but it is also possible to add platelets to other positions.

In calculating the eigenmodes represented in FIGS. 19A-G, the following dimensions and materials parameters were used:

Platelet: Lead, Diameter=5 mm, Thickness=0.5 mm

Membrane-1: Rubber, Diameter=16 mm

Membrane-2: Rubber, Width=6 mm

Membrane-3: Rubber, Width=4 mm, fixed on the outer cylinder with inner diameter=28 mm Cylinder-1: Acrylonitrile Butadiene Styrene (ABS), Thickness=1 mm, Height=3.2 mm, Inner diameter=16 mm Cylinder-2: ABS, Thickness=1 mm, Height=6.2 mm, Inner diameter=23 mm Mode 1 (FIG. 19A) at 95.3 Hz and Mode 3 (FIG. 19C) at 324 Hz are dipole-like of the first level unit without distortion of the second level unit, while Mode 2 (FIG. 19B) at 104.6 Hz is a monopole-like excitation corresponding to the first level unit, but without the distortion of the second level unit. Modes 4 and 5 (FIGS. 19D and E) at 458 Hz are degenerate monopole excitations of the second level unit. Mode 6 (FIG. 19F) is a hybrid of first level monopole excitation and second level dipole excitation. The contribution of such mode to the effective mass and effective modulus could give rise to new acoustic phenomenon. Mode 7 (FIG. 19G) is a collective dipole mode, with both the first and the second level units in dipole excitation.

CONCLUSION

It will be understood that many additional changes in the details, materials, steps and arrangement of parts, which have been herein described and illustrated to explain the nature of the subject matter, may be made by those skilled in the art within the principle and scope of the invention as expressed in the appended claims.

What is claimed is:

1. A device with simultaneous negative effective mass density and bulk modulus, comprising:

at least one tubular section;

front and back membranes sealing the tubular section sufficiently to establish a sealed or restricted enclosed fluid space defined by the tubular section and the membranes, the sealing or restriction restricting escape or intake of fluid resulting from acoustic vibrations; and a pair of platelets, each platelet mounted to and substantially centered on respective ones of the front and back membranes.

2. The device with simultaneous negative effective mass density and bulk modulus of claim 1, wherein the tubular section has a cylindrical shape, with each of the front and back membranes substantially identical.

3. The device with simultaneous negative effective mass density and bulk modulus of claim 1, wherein the tubular section has a frustoconical shape.

4. The device with simultaneous negative effective mass density and bulk modulus of claim 1, wherein the tubular section has a non-cylindrical shape, with each of the front and back membranes substantially identical.

5. The device with simultaneous negative effective mass density and bulk modulus of claim 1, wherein the tubular section has a non-cylindrical shape, with each of the front and back membranes having different diameters.

6. The device with simultaneous negative effective mass density and bulk modulus of claim 1, wherein an axial length of the tubular section affects an operative resonant frequency or eigenfrequency of the device with simultaneous negative effective mass density and bulk modulus.

7. A device with simultaneous negative effective mass density and bulk modulus, comprising:

a first hollow cylinder of rigid material of a predetermined height;

an elastic membrane fixed to at least one end of the first hollow cylinder and forming a seal of said one end;

at least one minor cylinder suspended within the first hollow cylinder by the membrane;

an elastic membrane attached to an open end of the minor cylinder and forming a seal of said open end;

at least two platelets of substantially identical construction, with one platelet attached to the center of the membrane attached to the open end of the minor cylinder, whereby an axial length of the minor cylinders affects an operative resonant frequency or eigenfrequency of the device with simultaneous negative effective mass density and bulk modulus.

8. The device with simultaneous negative effective mass density and bulk modulus of claim 7, further comprising:

at least two minor cylinders mounted on the elastic membrane fixed to the first hollow cylinder, with the elastic membrane fixed to the first hollow cylinder sealingly forming a division between the two minor cylinders;

the elastics membrane attached to an open end of the minor cylinders positioned on the minor cylinders axially at opposite ends of the minor cylinders from the elastic membrane fixed to the first hollow cylinder, so that the elastic membrane fixed to the first hollow cylinder forms the sealing relationship between the two minor cylinders, and the elastic membranes fixed to the open end of the minor cylinders forms sealing relationships at the opposite ends of the cylinders from the elastic membrane fixed to the first hollow cylinder; and the minor cylinders each have a single platelet mounted to the elastic membranes attached to the open end of the minor cylinders but no platelet mounted to the elastic membrane fixed to the first hollow cylinder.

9. The device with simultaneous negative effective mass density and bulk modulus of claim 7, further comprising:

a second elastic membrane fixed to an opposite end of said at least one end of the first hollow cylinder and forming a seal of said one end, and having an arrangement of minor cylinders mounted thereto.

10. The device with simultaneous negative effective mass density and bulk modulus of claim 7, further comprising:

said at least one minor cylinder suspended within the first hollow cylinder by the membrane by attachment to an outer circumference of the minor cylinder substantially at a mid-portion of the minor cylinder taken along the axial direction;

an elastic membrane attached to each open end of the minor cylinder and forming a seal of said open ends; and a platelet mounted to each of the elastic membranes attached to the open ends of the minor cylinders.

11. The device with simultaneous negative effective mass density and bulk modulus of claim 7, further comprising:

a second elastic membrane fixed to an opposite end of at least one end of the first hollow cylinder and forming a seal of said one end, and having an arrangement of minor cylinders mounted thereto.

12. The device with simultaneous negative effective mass density and bulk modulus of claim 7, wherein:

the elastic membrane fixed to at least one end of the first hollow cylinder has a different thickness or had different component materials from the elastic membrane attached to the open end of at least one of the minor cylinders.

* * * * *